United States Patent [19]

Kuhnert et al.

[11] 4,292,564

[45] Sep. 29, 1981

[54] LAMP/REFLECTOR UNIT

[75] Inventors: Volker Kuhnert, Kerkrade, Netherlands; Dieter Wilhelm, Eschweiler, Fed. Rep. of Germany

[73] Assignee: U.S. Philips Corporation, New York, N.Y.

[21] Appl. No.: 49,527

[22] Filed: Jun. 18, 1979

[30] Foreign Application Priority Data

Jul. 6, 1978 [DE] Fed. Rep. of Germany ..... 2829677

[51] Int. Cl.[3] ..... H01J 5/16; H01J 5/48; H01J 5/50

[52] U.S. Cl. ..... 313/318; 313/113

[58] Field of Search ..... 313/318

[56] References Cited

U.S. PATENT DOCUMENTS 3,265,923 8/1966 Preziosi et al. ..... 313/318

3,441,778 4/1969 Deiss ..... 313/318

4,195,245 3/1980 Miyazawa ..... 313/222 X

*Primary Examiner*—Robert Segal

*Attorney, Agent, or Firm*—Robert S. Smith

[57] ABSTRACT

A light bulb is mounted in a reflector member, by means of mounting members, elongate intermediate members and support pins.

The mounting members each engage, opposite to each other, around a narrow side face of the pinch seal of the light bulb in a clamping manner. An intermediate member is connected to each of the mounting members and extends at least over a part of its length along an imaginary circle around the axis of the light bulb. Metal support pins are connected at one end to a respective intermediate member and at the other end to a contact member of the reflector member.

3 Claims, 5 Drawing Figures

LAMP/REFLECTOR UNIT

Figure 1:
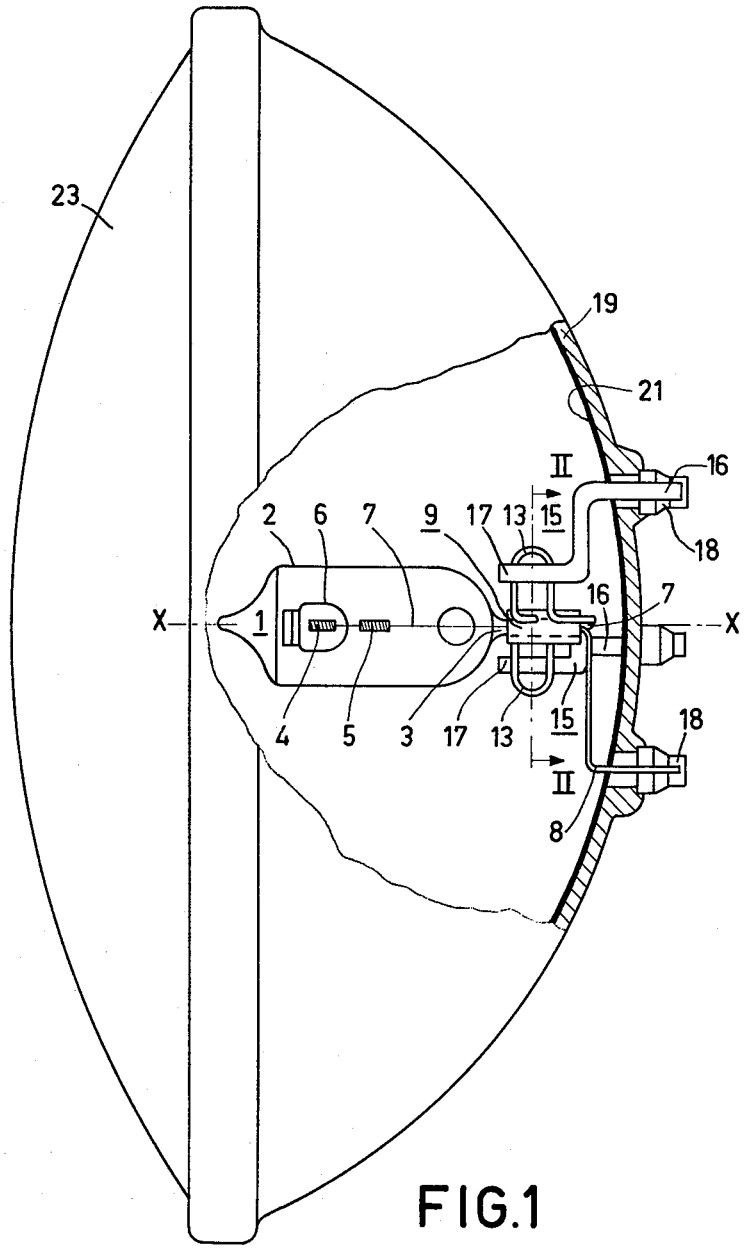

The invention relates to a lamp/reflector unit having a concave reflector member and a lens member attached thereto. A tubular light bulb is supported in spaced relation to the reflecting surface of the reflector member. The light bulb has a pinch seal at one end thereof which is substantially rectangular in cross-section and from which current conductors emanate which are in electrical contact with a filament disposed within the light bulb. The reflector member has mutually electrically insulated contact members, support pins being attached to respective ones of said contact members, each of said support pins also being connected to a respective one of the current conductors.

Such a unit is disclosed in U.S. Pat. No. 3,737,960.

In the known unit the support pins are directly secured to the current conductors and this joint constitute the only support of the light bulb. This means that the current conductors must be mechanically rigid, that the said joint is loaded mechanically in a varying manner when the unit is subjected to vibration and, furthermore, that the light bulb is supported only in a place which is far remote from the center of gravity of the light bulb. When the unit is subjected to vibration or shocks, which is the case e.g. when the unit is used as a headlight in vehicles, the light bulb will assume a position which varies considerably with respect to the reflector member.

It is the object of the invention to provide a lamp/reflector unit having a simple and rigid construction which enables the light bulb to be connected rapidly and simply in an aligned manner with respect to the reflector member.

A lamp/reflector unit of the kind mentioned in the opening paragraph and according to the invention has a pinch seal two having opposed mounting clips each engaging in a clamping manner around a respective narrow side of the pinch seal, each of said mounting clips having an elongate intermediate member attached thereto which extends at least over a part of its length along an imaginary circle having its center on the axis of the light bulb and lying in a plane transverse to said axis, said support pins being crank shaped and each of said intermediate members being attached to a respective one of the support pins.

The elongate intermediate members may be curved so as to extend along the imaginary circle over a substantial part of their length. Alternatively, they may however extend substantially tangentially along the imaginary circle.

In the construction of a unit according to the invention, the light bulb is supported nearer to its center of gravity. An important advantage of the construction is that it enables the light bulb to be mounted in a simple and rapid manner so as to be accurately and rigidly aligned relative to the reflector member. As a result of this, the construction is particularly suitable for use with light bulbs having two filaments to be used as headlights in motorcars. One of the two filaments is then arranged proximate to a low beam shield incorporated in the light bulb and serves to provide a low or dipped beam and the other one serves to provide the high or main beam. However, the construction may also be used advantageously with light bulbs having only one filament.

The elongate intermediate member may be a metal wire. In another embodiment said member, however, is a metal lug. In a special embodiment the elongate intermediate member is formed by a hairpin-shaped metal wire the limbs of which are secured to the mounting member with their free ends.

Intermediate members in the form of a metal lug or in the form of a hairpin-shaped metal wire have the advantage that the support pins can be secured to the intermediate members in more than one place, viewed in the axial direction of the light bulb. As a result of this the suspension of the light bulb is particularly stable.

In one embodiment, each mounting clip is generally U-shaped and is formed of a bent resilient metal strip, each side limb of the U sloping inwardly from the base of the U to a region where it engages a respective major surface of the pinch seal. This embodiment permits of a wide tolerance with respect to the size and the shape of the pinch seal of the light bulb. Burrs formed during the manufacture of the pinch seal do not affect the reliability of the clamping provided by the clips.

In a further embodiment, the base of the U-shaped bent metal strip which forms a mounting clip is curved inwardly of the U. Such a mounting clip assumes a readily defined position on the pinch seal even when the pinch seal of the light bulb is not exactly rectangular. For example, the pinch seal may be slightly trapezoidal in cross-section. This is due to the fact that the mounting clip contacts the pinch seal at three separate places.

Two current conductors may each be secured to a respective mounting element. When a lamp has two filaments, and consequently an additional current conductor, the latter may be secured directly to a further contact member of the reflector member.

The invention also relates to a light bulb having mounting members and elongate intermediate members for use in a lamp/reflector unit.

Figure 3:
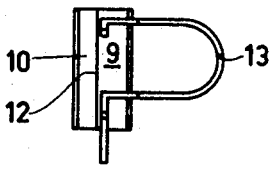
Figure 4:
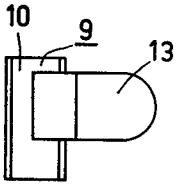
Figure 5:
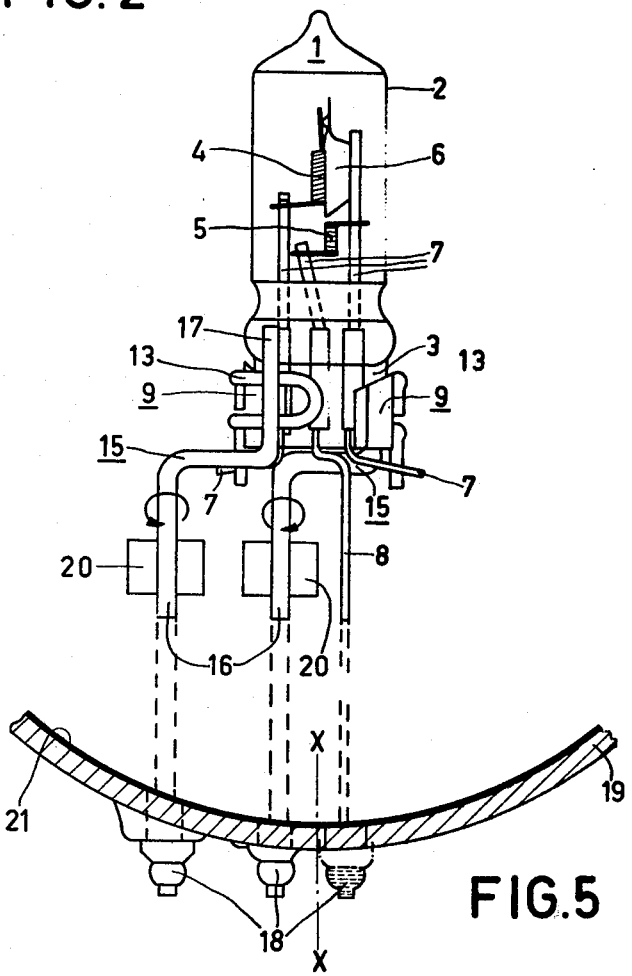

Embodiments of a lamp/reflector unit according to the invention are shown in the drawing. In the drawing FIG. 1 is a lamp/reflector unit partly broken away, FIG. 2 is a sectional view taken on the line II—II, FIGS. 3 and 4 are elevations of a mounting member with intermediate member, and FIG. 5 is an elevational view of a light bulb with mounting means and a sectional view of a reflector member.

In FIG. 1, a tubular light bulb 1 is denoted by 1. A low-beam filament 4, partly surrounded by a low beam shield 6, and a high beam filament 5 are accommodated in a quartz glass lamp vessel 2. The lamp vessel 2 is filled with a halogen-containing inert gas. Current conductors 7 extend through the pinch seal 3. Two mounting clips 9 are provided on the pinch seal 3 of which only one is visible. An elongate intermediate member 13 is welded to each of the mounting elements 9. Crank shaped support pins 15 are each welded at their ends 17 to respective intermediate members 13.

The ends 16 of the support pin 15 are connected to respective contact members 18 of reflector member 19. The end 8 of one of the current conductors 7 is connected to a third contact member 18. The reflector member 19 has a reflecting surface 21 and a lens member 23.

Figure 2:
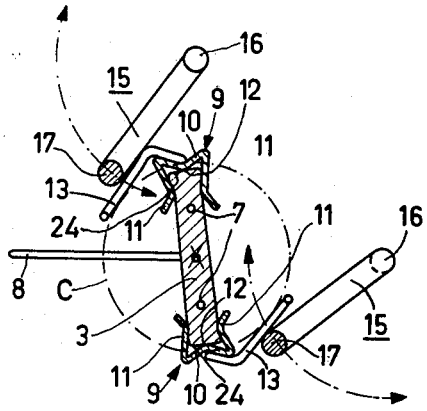

In FIG. 2, two mounting clips 9 of spring steel engage opposite ends of the pinch seal 3, in a clamping manner around a narrow side face 24 of the pinch seal 3. The side limbs 11 of the U-shaped mounting clips 9 are further apart at the base 10 than where they engage the major surfaces of pinch seal 3. The base 10 of each of the mounting clips 9 has an inward bend 12. A respective elongate intermediate member 13 is welded to each of the mounting clips 9 and extends substantially according to a tangent of an imaginary circle C having its center on the axis of the lamp vessel 2.

In FIG. 3 the intermediate member 13 consists of a hairpin-shaped wire, in FIG. 4 it consists of a metal lug. In both figures, reference numeral 9 again denotes a U-shaped mounting clip and 10 denotes the base of the U.

It will now be explained with reference to FIG. 5 how a light bulb is mounted so as to be accurately aligned with respect to the reflecting surface 21 of a reflector member 19.

Two support pins 15 are held with their ends 16 in tongs 20 in such manner that the distance between the ends 16 corresponds to the distance between the contact members 18 of reflector member 19 to which they are to be connected. The two current conductors 7 of the light bulb 1, which conductors lead to the low beam filament 4, are connected to the elongate intermediate members 13 each of which, in turn, is connected to a respective mounting clip 9. The elongate intermediate members 13 are curved over the major part of their length so as to extend along an imaginary circle (C in FIG. 2). The low beam filament 4 is then aligned with respect to the tongs 20 by moving the filament into a predetermined tolerance band, after which the support pins 15 with their ends 16 are rotated in the tongs 20 until their ends 17 each contact a respective elongate intermediate member 13. The end 17 and the relevant intermediate member 13 are then secured together by soldering or preferably, by welding. The ends 16 of the support pins 15 and the end 8 of the third current conductor 7 are then connected to the respective contact members 18, for example by soldering.

During the alignment and connection, the support pins 15 need not undergo a variation in shape. As a result of this no upper limit needs be imposed upon the rigidity of the pins.

What is claimed is:

1. A lamp/reflector unit having a concave reflector member and a lens member attached thereto, a tubular light bulb being supported in spaced relation to the reflecting surface of said reflector member, said light bulb having a pinch seal at one end thereof which is substantially rectangular in cross-section and from which current conductors emanate, said bulb including a filament disposed therein, said current conductors being in electrical contact with said filament disposed within said light bulb, said reflector member having mutually electrically insulated contact members, said unit including support pins attached to each of said contact members, each of said support pins also being connected to one of said current conductors, characterized in that the pinch seal is secured between two opposed mounting clips which each engage around a respective narrow side of the pinch seal in a clamping manner, each of said mounting clips having an elongate intermediate member attached thereto which extends at least over a part of its length along an imaginary circle having its center on the axis of the light bulb and lying in a plane transverse to said axis, said support pins being crank shaped and each of said intermediate members being attached to a respective one of said support pins.

2. A lamp/reflector unit as claimed in claim 1, characterized in that the elongate intermediate member is a hairpin-shaped metal wire the limbs of which are connected to the mounting member at their free ends.

3. A tubular light bulb as claimed in claim 1, characterized in that the elongate intermediate member is a metal lug.

* * * * *